United States Patent [19]

Tamari

[11] Patent Number: 4,672,749

[45] Date of Patent: Jun. 16, 1987

[54] MECHANICAL PERSPECTIVE DRAFTING DEVICE

[76] Inventor: Vladimir F. Tamari, 1-27-11, Shimmachi, Setagaya-ku, Tokyo 154, Japan

[21] Appl. No.: 745,806

[22] Filed: Jun. 17, 1985

[30] Foreign Application Priority Data

Jun. 26, 1984 [JP] Japan ..... 59-131519

[51] Int. Cl.[4] ..... B43L 13/00

[52] U.S. Cl. ..... 33/18.3; 33/20.3

[58] Field of Search ..... 33/18 C, 1 K, 1 CC, 33/20 C, 23 D

[56] References Cited

U.S. PATENT DOCUMENTS

| | | | |
|---|---|---|---|
| 398,865 | 3/1889 | Wade | 33/20 C |
| 2,746,152 | 5/1956 | Deakin | 33/18 C |
| 2,836,893 | 6/1958 | Barnett | 33/18 C |
| 3,175,295 | 3/1965 | Selley | 33/18 C |
| 3,657,820 | 4/1972 | Vermeulen | 33/18 C |

FOREIGN PATENT DOCUMENTS

| | | | |
|---|---|---|---|
| 576789 | 6/1959 | Canada | 33/18 C |
| 109960 | 4/1899 | Fed. Rep. of Germany | 33/20 C |

*Primary Examiner*—Willis Little

*Attorney, Agent, or Firm*—Oldham, Oldham & Weber Co.

[57] ABSTRACT

Mechanical perspective drafting device, characterized by a first drafting board which is fitted with a second drafting board with a fixed support which includes a universal joint through which a long member can slide and rotate freely, the long member being fitted with a drawing device ending with a point which can come in contact with the second drafting board, the line which is connecting the universal joint and the point is passing through an imaginary three dimensional figure and this causes the point to draw a perspective projection of the figure as it is seen from the position of the universal joint, the movement of the line through the figure is assisted by a tracing guide which guides the long member.

5 Claims, 5 Drawing Figures

MECHANICAL PERSPECTIVE DRAFTING DEVICE

DESCRIPTION

This invention is directed to a mechanical perspective drafting instrument that can easily convert a ground plan of a given 3-dimensional structure into a correct perspective drawing, drawn from any chosen viewpoint height and angle.

The perspector allows such drawings to be made without the use of distant vanishing points, complicated graphic constructions and calculations, or the use of sets of ellipse templates. This simplification in perspective drawing is made possible because the perspector itself is simply a working 3-dimensional model of a perspective situation, as will be shown below.

PRIOR ART

Modern computers can easily accomplish drawings, depending on computational methods which are unrelated to the graphic methods of the perspector. There exist several mechanical aids for perspective drawing, which help orient a ruler on the drafting board to pass through a given vanishing point which can lie outside the board. The perspector is completely unrelated to such devices since in the perspector's case no use whatsoever is made of vanishing points in making the perspective drawings.

U.S. Pat. No. 2,171,894, invented by J. T. Rule, contains some elements which are similar to those in the present device, particularly the idea of a sliding rod passing through a fixed point in space to represent the line of sight. However, Rule's invention was for the purpose of producing a pair of stereoscopic drawings of a freehand drawing or a tracing from an actual solid object. There was no provision for converting a given top view drawing into an actual perspective drawing drawn to the correct scale. It will be described later how part of the perspector mechanism can be adapted as an accessory with Rule's invention, to enable it to make stereoscopic perspective drawings of a given ground plan.

The much older devices described by the German artist Dürer are also working models of the perspective situation, but in Dürer's case, the device was used to trace an actual solid object or scene, not the making of a perspective of an imaginary structure or design (see "Journal of Graphic Science of Japan", No. 34 (1984), p 25).

SUMMARY OF THE INVENTION

It is an object of the invention to provide a simple instrument for drawing perspective projections.

According to the invention, the mechanical perspective drafting device is characterized by a first drafting board which is fitted with a second drafting board with a fixed support which includes a universal joint through which a long member can slide and rotate freely, the long member being fitted with a drawing device ending with a point which can come in contact with the second drafting board, the line which is connecting the universal joint and the point is passing through an imaginary three dimensional figure and this causes the point to draw a perspective projection of the figure as it is seen from the position of the universal joint, the movement of the line through the figure is assisted by a tracing guide which guides the long member.

It is preferred if the angle between the first and the second drafting board is adjustable.

This angle normally is 90°. But this is not always the case. If the angle is 90° a one point or two point perspective drawing will result. But if the angle is not equal to 90° then a three point perspective will result.

DETAILED EMBODIMENT OF THE INVENTION

In the following text preferred embodiments of the present invention will be explained in more detail.

Figure 1A:
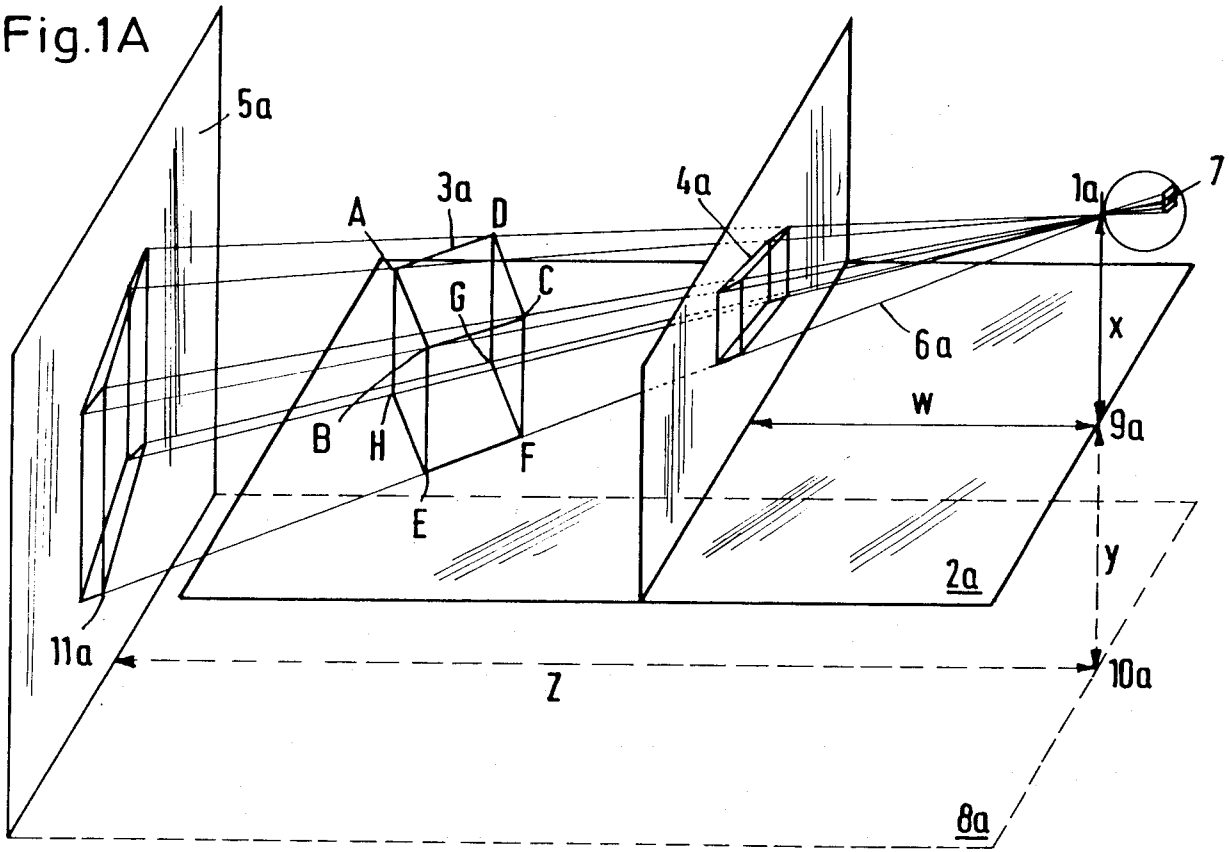
FIG. 1A is a perspective view to explain the principles of the present invention.

A perspective drawing on a flat page is optically similar to the image seen on the retina of an observer looking at a scene from a fixed point of view, with the page made vertical to the line of sight. In FIG. 1A, a classical perspective situation is shown in heavy lines. The observer's eye-lens 1*a* collects the optical rays from the object 3*a* placed on the ground plane 2*a*, and projects an image 7 on the retina. The image 7 is inverted, but is similar to the perspective drawing traced on a vertical picture plane 4*a*. Visual rays such as 6*a* connect the object to the drawing and the viewpoint 1*a*. The viewpoint 1*a* is at a vertical distance X from the plane 2*a*, and a distance W from 4*a*. It can also be seen that the projection of 3*a* from the point 1*a* can also be traced on any other vertical plane 5*a* parallel to 4*a* and at a distance Z from 1*a*, giving a larger, but similar perspective drawing to that drawn on 4*a*. Another plane 8*a* parallel to 2*a* is at a distance X+Y from 1*a*.

Figure 1B:
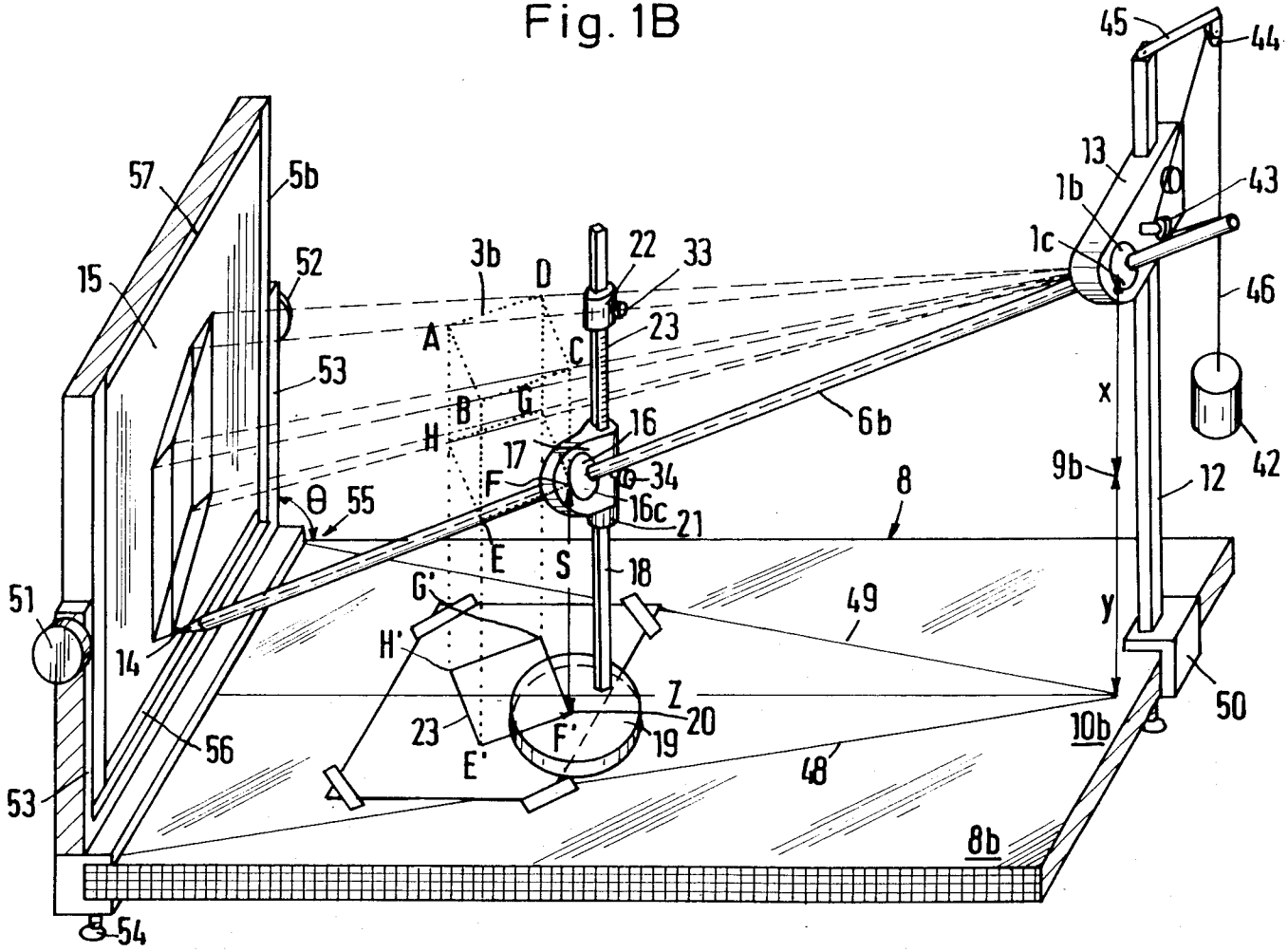
FIG. 1B is a similar perspective view showing a first embodiment of the mechanical perspecting drafting device.

FIG. 1B shows one embodiment of the perspector, which is a working mechanical model of the conceptual situation of FIG. 1A. For example, the viewpoint 1*a* in FIG. 1A becomes a spherical bearing 1*b* in FIG. 1B. The line of sight 6*a* becomes a straight member 6*b*.

A drafting board 8*b* supports a member 12 on which is fixed a member 13 containing a spherical bearing or any similar mechanism that constrains the straight member 6*b* to always slide through the center of rotation of 1*b*, which will be called 1*c* to distinguish the mechanism from its center of rotation. 1*c* is at a vertical distance X+Y from the plane of 8*b*. The member 13 can slide along 12 and can be locked at different heights X+Y. Part 12 can be conveniently clamped onto 8*b* by means of a clamp 50. The straight member 6*b* ends with a marking device such as a pencil or ball-point pen which draws lines on a paper 15 affixed to a vertical drawing board 5*b* fixed at an angle $\theta$ relative to the plane 8*b*.

For making a so-called 2-point perspective drawing, the angle $\theta$ is fixed at 90°, but for making a so-called 3-point perspective the angle $\theta$ must be fixed at more or less than 90°, depending on the point of view, by any means such as a pivot and knobs 51 and 52 which lock the vertical board 5*b* to a frame 53 which is attached by means of clamps 54 and 55 to the drawing board 8*b*.

The straight member 6*b* is further constrained by passing through a spherical bearing 16 or any similar mechanism that allows 6*b* to rotate and slide through the center of the bearing 16*c*. The marking device 14 must be placed in such a way that its tip and points 16*c* and 1*c* must all lie on one straight line. The spherical bearing 16 is fixed on a member 17 which can slide non-rotationally along a vertical member 18, fixed onto a flat preferably transparent base 19 containing crosshairs or lines inscribed on its lower side, which meet at all times at a point 20 perpendicularly below point 16*c*.

The member 17 can be locked at different heights along 18 by means of a lock 34, thus varying the distance S between 16*c* and 20.

A collar 21 serves to limit the lower movement of 17, and another collar 22 can be locked at varying height along 18 by means of lock 33, limiting the upper movement of 17.

In the simplest form of perspector, the collar 21 can be permanently fixed, and a scale 23 placed along 18 or inscribed on it to indicate the vertical movement of 17 starting from the zero position when 17 and 22 are in contact. However, in other embodiments the collar 22 can be locked at different heights, and a movable scale 28 can be attached to the collar, rather than fixed to 18, as will be shown.

Figure 3A:
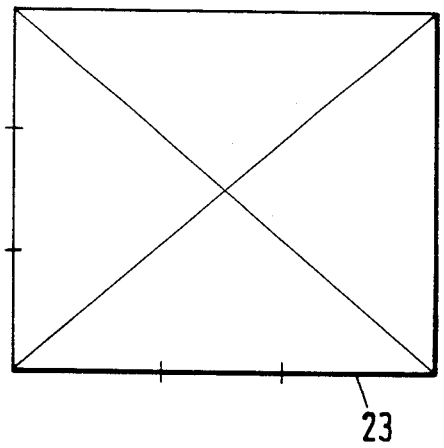
FIG. 3A is a top view of a house showing in a perspective view in FIG. 3B for explaining some other details of the present invention.

A ground plan or top view 23 of the structure whose perspective is to be drawn is placed onto the board 8*b*. For the purpose of this invention the term ground plan or top view must be modified to mean the projection onto a horizontal plane of all the contours of the intended structure, regardless of their actual position in space. For example the drawing of FIG. 3A shows the inclined lines of the roof flattened out as a cross shape on the ground plan. It is also preferable to have available a small rough sketch of the intended structure showing the relative heights of various points, as an aid in making the final perspective, such as that shown in FIG. 3B.

The base 19, vertical member 18 and all the parts attached to them are an essential part of the perspector and are collectively called the tracing unit. This unit is used to trace the outline of the ground plan 23, and also to trace any vertical lines of the structure by adjusting the height S of 16*c*.

Figure 2:
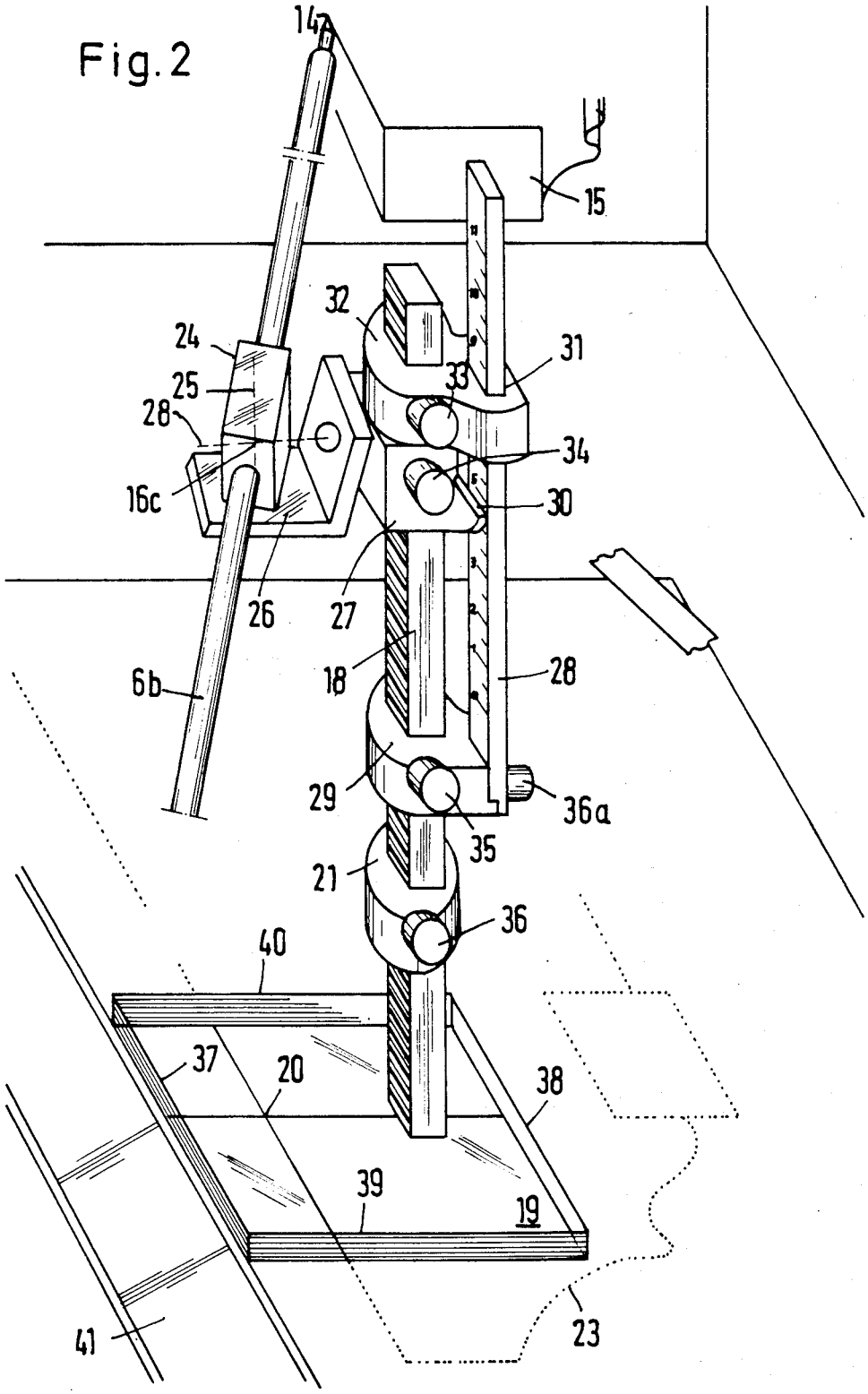
FIG. 2 is a perspective view similar to FIG. 1B to explain a second embodiment.

FIG. 2 shows another embodiment of the tracing unit. Instead of the spherical bearing 16, a bushing 14 is pivoted to rotate about an axis 25 fixed on angle 26, which rotates around an axis 28, attached to a member 27 which can slide non-rotationally along vertical member 18. It is desirable that the sliding motions of the straight member 6*b* through the bushing 24, and of member 27 along 18 be as smooth as possible, and the use of the linear bearings is preferred.

Any other mechanism that serves to constrain 6*b* in the manner described can be also used.

A vertical ruler 28 is attached to a collar 29 which can be locked at any desired height along 18 between collar 21 and part 27. A mark 30 on member 27 points to zero on the ruler 28 whenever member 27 is allowed to rest freely on the collar 29. Ruler 28 can be ruled with a centimeter or inch scale or it can be replaced with another ruler marked with a different scale in order to match the scale of the ground plan. Ruler 28 passes through a smoothly fitting aperture 31 made in the body of collar 32. Locks 33, 34, 35, 36 can lock the parts 32, 27, 29, 21 respectively to the desired position on member 18. A lock 36*a* locks the ruler 28 to the collar 29.

The base 19 shown in FIG. 1B has a circular shape with the point 20 preferably at the circle's center. It is also possible to have a rectangular or square shaped base 19 (as in FIG. 2), with straight edges 37 and 38 cut perpendicularly to edges 40 and 39, with the crosshairs drawn parallel to these edges. A hand-held ruler 41 or the edge of a drafting machine can be used to help move the tracing unit over the lines of the ground plan.

In order to help push the member 6*b* towards the board 5*b*, some means of applying constant pressure such as a spring of electromagnetic solenoid can be used. In the present embodiment a counterweight 42 suspended by a string 46 passes through a pulley 44 which is suspended from a member 45 attached to the top of member 12. The string then passes through another pulley 43 attached to member 13 and is then attached to the extremity of straight member 6*b*.

It is preferable to have the ground plan covered with a thin but strong transparent sheet of plastic to prevent wear to the drawing resulting from the movement of the tracing unit base 19 over the ground plan 23. As a further aid, lines 48 and 49 can be permanently drawn on the drawing board 8*b* joining point 10*b* to the points on the opposite side of the board which lie under the left and right edges of the paper 15. The lines 48 and 49 will then indicate the allowable drawing zone for the ground plan. Paper holders or clips 56 and 57 will be a convenience to hold paper 15 onto the vertical board.

For using the device, the ground plan 23 is fixed to the drafting board 8*b* at any desired orientation and distance relative to the viewpoint 1*b* (or its projection 10*b*). The lines of 23 must all lie within the allowable drawing zone limited by lines 48 and 49. The height of ground plan the viewpoint 1*b* is then adjusted as required, by locking member 13 at the required height X+Y. Next the locks 34, 35, 36 are opened and the point 20 of the tracing unit is held firmly to coincide with the point on the ground plan nearest to point 10*b*, the member 27 is raised and lowered until the marking point 14 lies above the level of the paper clamp 56. Member 27 is then locked in place and collars 35 and then 29 are pushed up against member 27 and also locked, establishing the lowest horizontal level of the structure model of FIG. 3*b*. This is shown by the zero reading shown by mark 30 on the scale 28. For example, if the point 20 is then moved over line F'G' in FIG. 1B, the center 16*c* will move over the conceptual model's lower edge FG, and the marking point 14 will automatically draw the perspective of this line on the paper 15.

A vertical line such as FC is drawn by holding the base 19 firmly in place with the crosshairs 20 on the point F'. Then, with the lock of member 27 open (but collars 29 and 21 still locked) the member 27 is pushed vertically upwards by the required distance as measured on ruler 28. Marking point 14 will then automatically draw the correct perspective. When many vertical lines of the same height have to be drawn, the upper collar 32 is locked at the proper height so that the mark 30 will read the required vertical height when 27 is pushed vertically until it touches collar 32. To draw an elevated horizontal section such as ABCD, 27 is locked at the required height, and the lines E'F'G'H' retraced. Curved lines on any horizontal plane can be traced freehand from the ground plan. In all cases the point 14 will draw the correct perspective on paper 15. The same structure can be drawn from another point of view simply by changing the orientation of the ground plan on the board 8*b* and by lowering and raising the point of view 1*b*.

Figure 3B:
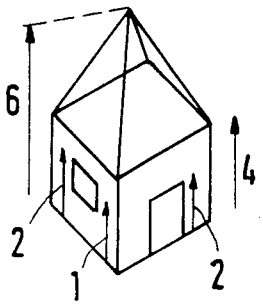

The ruler 18 can also be used to measure out a series of verticals that do not start from zero ground level, such as the sides of their windows in the structure of FIG. 3B. In this case the collar 29 is locked at the higher level so that the zero mark will now start at the height of the window edge. The collar 21 is always kept locked throughout each drawing, to preserve the absolute ground level. In order to draw tilted lines such as the roof lines of FIG. 3A, draw the perspectives of the beginning and end points only, and join these points manually on 15.

For simulating the effect of tilting the picture plane to get a so-called 3-point perspective, in which the verticals converge to a vanishing point, the knobs 51 and 52 are used to change the angle $\theta$. If the $\theta$ is less than 90°, the effect is that of an elevated point of view looking down on the structure. A low point of view is obtained by making $\theta$ more than 90°.

The mechanisms just described are just one embodiment of the novel device. With slight modifications of design the tracing units can be used to become an accessory for converting Rule's stereoscopic drawing instrument mentioned above to produce a stereoscopic pair of perspective drawings made from a ground plan: This is accomplished by replacing the spherical bearing 16 by a ball joint attached to the tracing rod of Rule's apparatus, and then proceeding to use the tracing unit as described above.

On the other hand a number of accessories can be used with or attached to the basic perspector design, to allow the direct tracing of lines from three dimensional templates and rulers.

I claim:

1. A mechanical perspective drafting device comprising a first drafting board, a second drafting board positioned on said first drafting board and forming an angle ($\theta$) therewith; a training unit including a base, a vertical member on said base and extending upwardly therefrom, and a support member on said vertical member and adjustable vertically therealong; and a long member, said support member including a universal joint by which said long member is mounted and through which said long member can slide and rotate freely, said long member being fitted with a drawing device ending with a point which can come in contact with said second drafting board, the universal joint and the point defining a line which is passing through an imaginary three dimensional figure and this causes the point to draw a perspective projection of the figure as it is seen from the position of the universal joint, the movement of the line through the figure being assisted by said base that forms a tracing guide which guides said support member and thereby the long member and enables a manual tracing of a figure on said first board, and where a plurality of stops are present on said vertical member to limit movement of said support member vertically of said member.

2. Mechanical perspective drafting device characterized by a first drafting board which is fitted with a second drafting board with a fixed support which includes a universal joint through which a long member can slide and rotate freely, the long member being fitted with a drawing device ending with a point which can come in contact with the second drafting board, the line which is connecting the universal joint and the point is passing through an imaginary three dimensional figure and this causes the point to draw a perspective projection of the figure as it is seen from the position of the universal joint, the movement of the line through the figure is assisted by a tracing guide which guides the long member, said drafting device containing a second universal joint the height of which above the first drawing board can be limited by an upper lock and a lower lock at which the zero point of a vertical scale is located, said lower lock being an integral part of said scale.

3. A drafting device according to claim 2 in which the tracing guide contains a rectilinear transparent base containing crosshairs at substantially right angles to each other, each of said crosshairs being parallel to two of the sides of the rectilinear base, with the point of intersection of the crosshairs always being perpendicularly below the point of rotation of said second universal joint.

4. A drafting device according to claim 2 wherein the tracing guide has in combination therewith a vertical member on which there is provided an additional lock to preserve a chosen absolute ground level of the second universal joint passing through the imaginary three dimensional figure.

5. A drafting device according to claim 4 in which the tracing guide contains a rectilinear transparent base containing crosshairs at substantially right angles to each other, each of the said crosshairs being parallel to two of the sides of the rectilinear base, with the point of intersection of the crosshairs being always perpendicularly below the point of rotation of said second universal joint.

* * * * *